US006952850B2

(12) United States Patent
Visser et al.

(10) Patent No.: US 6,952,850 B2
(45) Date of Patent: Oct. 11, 2005

(54) NO-FLIP MATTRESS SYSTEMS AND METHODS

(75) Inventors: Barney D. Visser, Denver, CO (US); Robert L. Rensink, Denver, CO (US)

(73) Assignee: Denver Mattress LLC, Lakewood, CO (US)

( * ) Notice: Subject to any disclaimer, the term of this patent is extended or adjusted under 35 U.S.C. 154(b) by 0 days.

(21) Appl. No.: 10/705,640

(22) Filed: Nov. 10, 2003

(65) Prior Publication Data

US 2004/0148706 A1 Aug. 5, 2004

Related U.S. Application Data

(63) Continuation-in-part of application No. 09/989,003, filed on Nov. 21, 2001, now Pat. No. 6,643,876.

(51) Int. Cl.[7] ..... A47C 27/05; A47C 27/00; A47C 27/08

(52) U.S. Cl. ..... 5/690; 5/706; 5/740; 5/727; 5/720

(58) Field of Search ..... 5/727, 690, 716, 5/720, 740, 731, 736, 706, 721

(56) References Cited

U.S. PATENT DOCUMENTS

| | | | |
|---|---|---|---|
| 2,862,214 | A | 12/1958 | Thompson et al. |
| 3,869,739 | A | 3/1975 | Klein |
| 5,040,255 | A | 8/1991 | Barber, Jr. |
| 6,023,803 | A | 2/2000 | Barman |
| 6,243,900 | B1 | 6/2001 | Gladney et al. |
| 6,295,676 | B1 | 10/2001 | Warner |
| 6,408,469 | B2 | 6/2002 | Gladney et al. |
| 2002/0184712 | A1 | 12/2002 | Gladney et al. |

FOREIGN PATENT DOCUMENTS

| | | |
|---|---|---|
| DE | 8809029.9 | 3/1989 |

*Primary Examiner*—Alexander Grosz
(74) *Attorney, Agent, or Firm*—Townsend and Townsend and Crew LLP

(57) ABSTRACT

A no-fip mattress is constructed of a mattress core, a first padding layer positioned on top of the core, wherein the first padding layer has a density in the range from about 0.5 pounds per cubic foot to about 3 pounds per cubic foot and a firmness in the range from about 8 IFD to about 45 IFD. A second padding layer is adjacent to the first padding layer, wherein the second padding layer has a density in the range from about 0.5 pounds to about 1.9 pounds, and an IFD in the range from about 5 to about 23. A bottom support layer is beneath the core, and comprises a relatively dense and firm material.

25 Claims, 5 Drawing Sheets

NO-FLIP MATTRESS SYSTEMS AND METHODS

CROSS-REFERENCES TO RELATED APPLICATIONS

This invention is a continuation in part application and claims the benefit of Ser. No. 09/989,003 now U.S. Pat. No. 6,643,876, filed Nov. 21, 2001, the complete disclosure of which is herein incorporated by reference.

This application is also related to copending U.S. application Ser. No. 10/704,879, filed on Nov. 10, 2003 the complete disclosure of which is herein incorporated by reference.

BACKGROUND OF THE INVENTION

This invention relates generally to the field of mattresses, and in particular to so called one-sided or no-flip mattresses. More specifically, the invention in one embodiment relates to such mattresses that are constructed using an inner core of springs although other cores may be used as well.

Spring mattresses have been in use for over 100 years. Existing spring mattresses use a variety of spring types to form their inner core. Perhaps the most common is the traditional wire spring assembly having a set of interconnected wire spring coils. As is well known in the art, a major supplier of such springs is Leggett & Platt.

Another type of spring assembly is the so-called Marshall construction that was developed in the late 1890's by Marshall Mattress of Toronto, Canada. The Marshall design utilizes fabric pockets to encapsulate each spring. In this way, the coils may flex separately from each other. Examples of such pocket coil spring designs are described in, for example, U.S. Pat. Nos. 685,160; 4,234,983; 4,854,023; 6,029,957; and 6,295,676 and published PCT No. WO99/32396, among others. The complete disclosures of all these references are herein incorporated by reference.

Traditional mattresses have a padding layer disposed both on top of and beneath the core of springs. This is encased within a fabric or ticking, and may optionally include additional layers of padding to form a "pillow top" mattress as is known in the art. Because of potential uneven wear during the life of the mattress, many manufacturers recommend periodically rotating or flipping the mattress. However, because this can be difficult and inconvenient, many users do not follow this practice. For those that do, this exercise can be annoying.

As a result, the one-sided or no-flip mattress has been developed. Several manufacturers have developed and sold such mattresses at least as early as the mid 1990s. For instance, Sleep Therapy mattresses have been sold by Wickline Bedding Co., San Diego, Calif. since the early 1990s. These mattresses have a polyurethane foam layer underneath the springs and a traditional padding layer on top. This design was subsequently adopted by Simmons Company as demonstrated by their U.S. Pat. No. 6,243,900, the complete disclosure of which is herein incorporated by reference.

This invention is related to improved methods for manufacturing so called one-sided or no-flip mattresses. As described hereinafter, such mattresses provide increased firmness, stability and comfort, among other features. Further, such mattresses may be economically produced to provide a commercially attractive mattress.

BRIEF SUMMARY OF THE INVENTION

The invention provides exemplary mattresses as well as methods for their construction. In one embodiment, a mattress comprises a core of springs having a fabric covering. For example, the springs may be individually encased in fabric pockets. A top padding layer is positioned on top of the core of springs, and a bottom support layer is disposed below the core of springs. The bottom support layer is bonded to the fabric covering of the core to couple the bottom support layer to the core of springs. Such a construction is particularly useful where at least some of the fabric pockets are pre-joined to each other near midpoints of the coils so that independent movement of both the tops and bottoms of the coils is permitted. By bonding the bottom support layer to the fabric covering, additional stability is provided to the mattress by limiting the lateral movement of the bottoms of the springs relative to each other while still permitting individual movement of the tops of the springs relative to each other.

Another feature of such mattresses is that the bottom support layer may be constructed of a matrix of foam elements, such as a rebond material. Such materials are relatively dense, have good firmness, and are still cost effective. For example, the bottom support layer may have a density of about 3 pounds per cubic foot or greater, with one particularly useful density being about 3.5 to about 4.5 pounds per cubic foot. The firmness of the bottom support layer may be measured in terms of its mean indentation force deflection (IFD) that may be in the range from about 30 to about 80, and more preferably from about 50 to about 70. Further, the bottom support layer may have a thickness in the range from about 0.5 inches to about 3 inches and may be formed from one or more stacked pieces.

In one aspect, a border element, such as a border wire, may be coupled to a perimeter of the core of springs. For example, the border wire may be clipped to the individual coils with rings. In some cases, a border wire may not be included. In one alternative, a foam encasement or other border material may be used to replace one or more of the outside rows of springs so that a border wire is not needed. Such a foam encasement may be used with any of the embodiments described herein.

In another aspect, a quilted material may be placed over the top layer, and a border material may be secured about the sides of the mattress. A cover material may also be placed over the bottom support layer.

To manufacture such a mattress, the bottom support layer is bonded to the fabric pockets using a bonding material, such as glue. The top padding layer is placed on top of the core of springs and a quilted or other material is placed over the core and top and bottom layers.

In another embodiment, the invention provides a no-flip mattress that comprises a mattress core, a first padding layer positioned on top of the core and a second padding layer adjacent to the first padding layer. The first padding layer also has a contoured surface that is positioned against the second padding layer. Further, a bottom support layer is beneath the core and comprises a relatively dense and firm material. The first and second padding layers may be incorporated into the quilting (such by using a gusset) to form a pillow top mattress, or may be by incorporated directly into the mattress, known as a plush top arrangement.

The bottom support layer may be constructed of a variety of materials, such as a matrix of foam elements, a polyurethane foam, densified fibers, and the like. It may also have a firmness in the range from about 30 IFD to about 80 IFD, a density greater than about one pound per cubic foot, and a thickness of about 0.5 inch to about 3 inches.

The first and second padding layers may comprise a foam (such as polyurethane foam), with the contoured surface being convoluted. The convoluted surface may face away from or toward the core. The second padding layer has a density in the range from about 0.5 pounds per cubic foot to about 1.9 pounds per cubic foot, and a firmness in the range from bout 5 IFD to about 23 IFD. In some cases, two second padding layers may be used in combination with the first padding layer having the contoured surface. The second padding layers may both be positioned on top of the first layer, or one may be above and one below. In another alternative, the mattress may include two first layers of foam that are convoluted in combination with the second layer. For example, the two first layers may have their contoured surfaces facing up, with the second layer resting on the contoured surface of the top first layer. As another example, one of the first layers may having its contoured surface facing up with the other first layer having its contoured surface facing down. The second layer rests on the contoured surface of the top first layer.

A wide variety of cores may be used including open coil springs, pocket coil springs, latex rubber, visco-elastic materials, air or water bladders and the like.

DETAILED DESCRIPTION OF THE INVENTION

Figure 1:
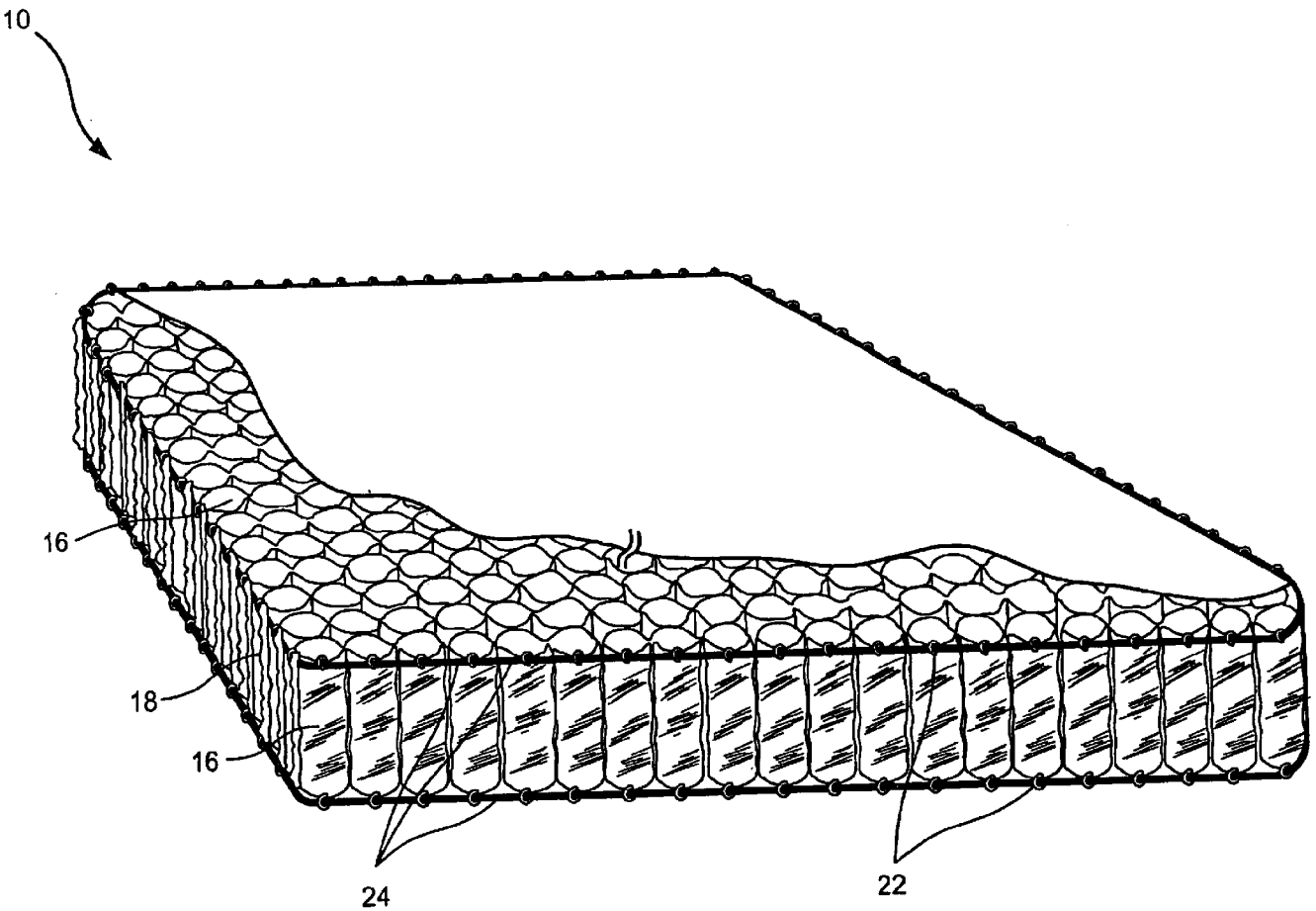
FIG. 1 is a top perspective view of a core of individually pocketed springs to which are coupled a pair of border wires.

The invention provides exemplary no-flip mattresses and methods for their construction. In one particular embodiment, such mattresses may be constructed using springs that are encased in fabric. The springs may be individually encased in fabric, or groups of springs may be encased. Although useful with any core of springs that are encased in fabric, the mattresses of some embodiments of the invention will achieve particular advantages when constructed of pocket coil springs that are able to move independently from one another. For example, the mattresses may be constructed of pocket coil springs that are formed as strings, with the strings being coupled to each other near midpoints of adjacent springs, although other techniques may be used as well. The strings may be coupled to each other by using thermal welds or a continuous line of glue passing along the strings, among others. Such spring assemblies are constructed so that individual springs can compress independent of each other to provide comfort to the user. Examples of such spring assemblies are described in PCT Publication No. WO99/32963 and U.S. Pat. Nos. 6,029,957 and 4,578,834, among others. These disclosures are herein incorporated by reference. Other types of mattress cores that may be used include those made out of latex rubber, interconnected springs, visco-elastic materials air or water bladders, and the like. Further, although described as a no-flip mattress, it will be appreciated that the other side of the mattress could be used as a sleep surface as well, especially in situations where the user needs a firm surface.

According to one embodiment of the invention, a bottom support layer is bonded directly to the fabric encasing the springs. This prevents lateral movement of the bottoms of the springs relative to each other and provides stability to the core of springs. At the same time, at least some or all of the top ends of the springs remain unattached to each other and therefore may move independent of each other. In this way, the mattress has both stability and comfort, and particularly more stability than that provided when only using a border rod to hold the springs together.

Another feature of the mattresses of the invention is that they may utilize a relatively dense bottom support layer to provide the mattress with increased durability. For example, the bottom support layer may have a density that is about one pound per cubic foot or greater, more preferably from about 3 to about 8 pounds per cubit foot, and most preferably from about 3.5 to about 4.5 pounds per cubic foot. One particularly effective material is a matrix of foam pieces, known as rebond. This material is firm and is constructed of a variety of small urethane or other foam pieces (typically reclaimed) that are joined together using an adhesive, heat and steam that tend to increase the density. Such a material is relatively dense, has an IFD in the range from about 40 to about 80 and is relatively inexpensive. The IFD may vary depending on the IFDs of the individual pieces and may vary throughout the support layer. As such, the IFD may conveniently be defined in terms of a mean or average IFD. By using such a material, the mattress may have a durable construction while being relatively inexpensive. Other types of materials that may be used include polystyrene materials. Other kinds of materials that may be used to construct the bottom support layer include polyurethane, densified fibers and the like. When using polyurethane, it may have a density in the range from about 1 pound to about 3 pounds, and an IFD of about 30 to about 50.

Figure 2:
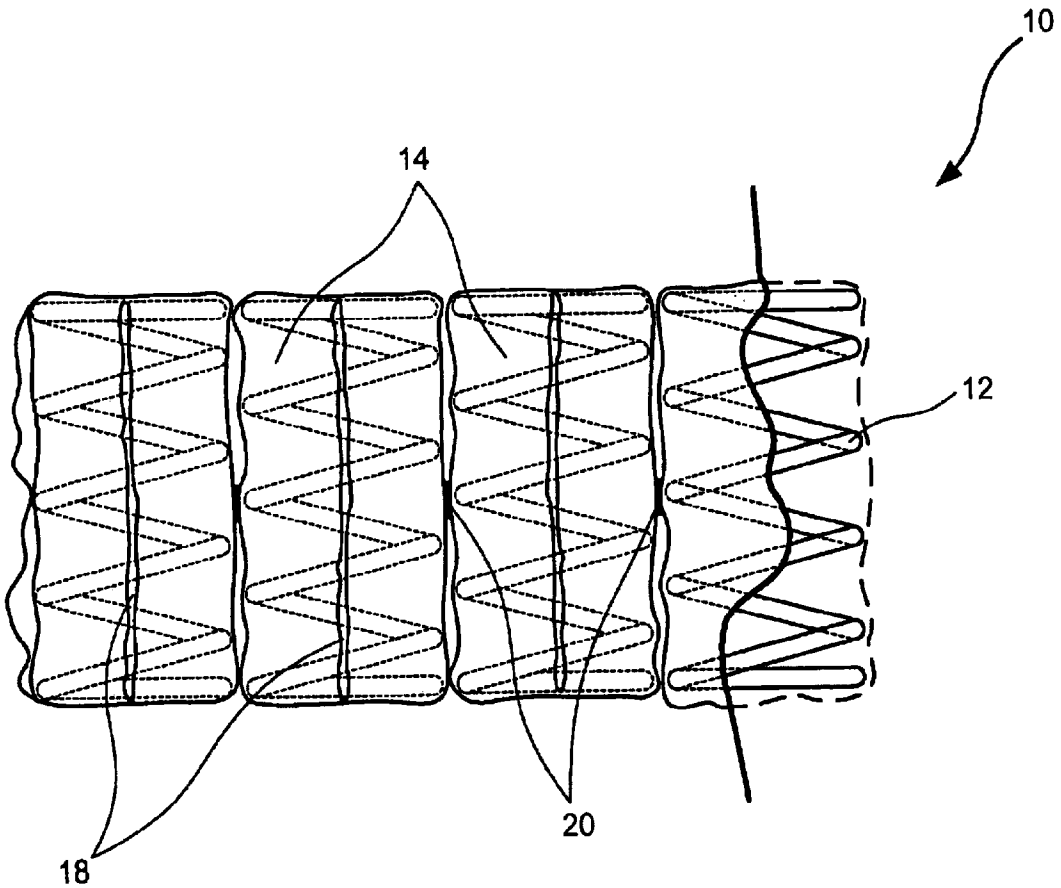
FIG. 2 is a side view of a section of pocketed springs of the core of FIG. 1.

Referring now to FIGS. 1 and 2, one embodiment of a core 10 of springs 12 will be described. Core 10 may be used as part of a no-flip mattress as described hereinafter with reference to FIG. 3. However, the invention is not intended to be limited only to mattresses using such cores. For example, other cores that may be used include those having open coil springs, latex cores, and the like. Core 10 is constructed of a plurality of fabric pockets 14 into which springs 12 are disposed. As will be appreciated, a variety of techniques may be used to form pockets 14, to place springs 12 into pockets 14 and to secure pockets 14 together. For example, techniques that may be used to form core 10 are set forth in the patents and publications previously incorporated by reference.

As shown in FIGS. 1 and 2, core 10 is constructed of multiple strings 16 of fabric pockets 14 that include springs 12. Each string 16 may be formed from a single sheet of fabric that is sewn or welded together at seams 18 to form pockets 14. Strings 16 are joined to each other near midpoints 20 as shown in FIG. 2. This may be a continuous glue line, an internal weld, or the like. Such a configuration permits independent movement of adjacent springs 12 to enhance the degree of comfort provided by core 10.

Secured about a perimeter of core 10 are border rods 22. A set of rings 24 are used to clip border rods 22 to individual springs 12 as shown in FIG. 1. Border rods 22 help stabilize the outer edges of core 10 by holding the outer springs together.

Figure 3:
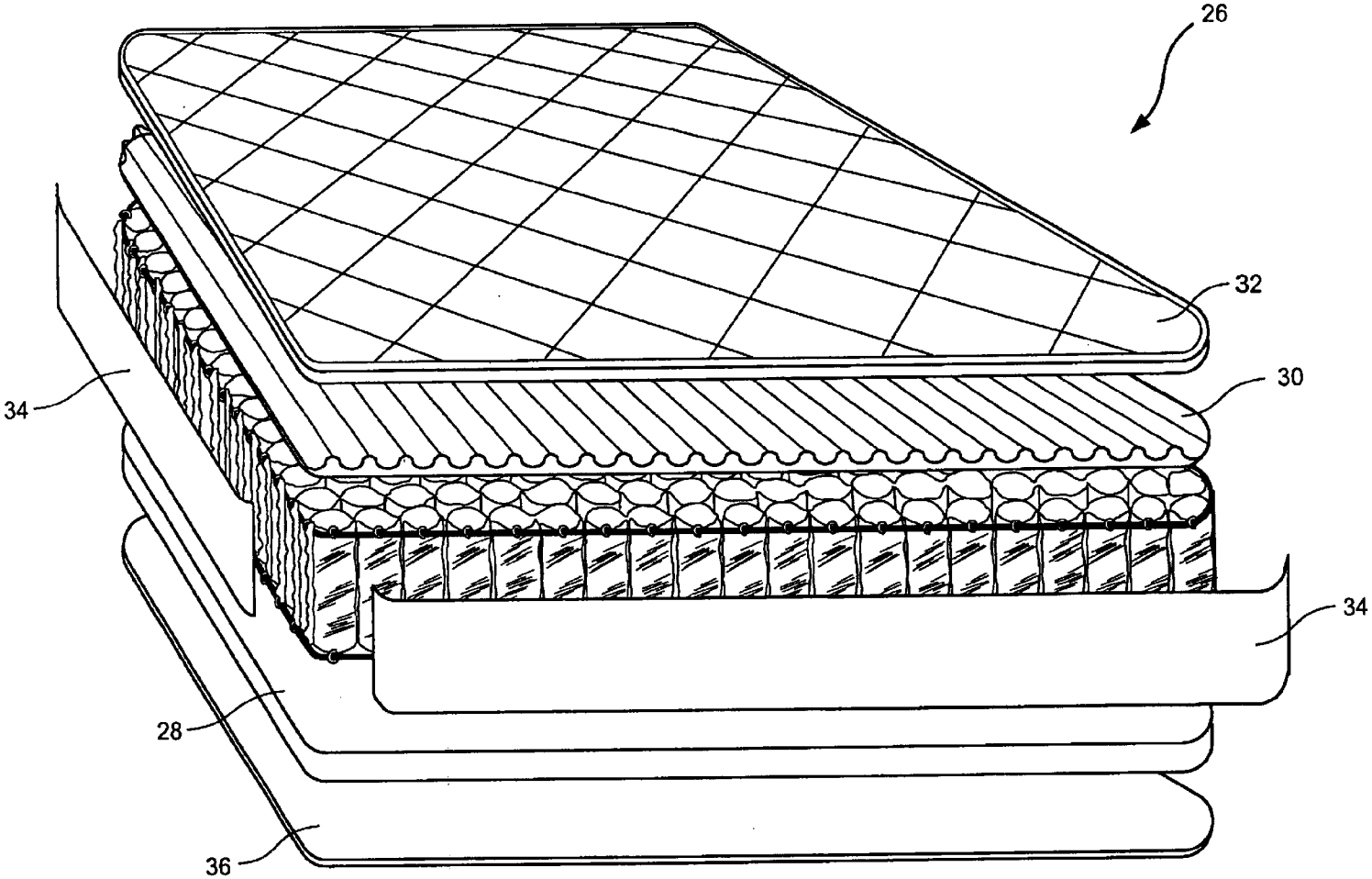
FIG. 3 is an exploded view of a mattress having the core of springs of FIG. 1 according to the invention.

Shown in FIG. 3 is a mattress 26 that includes core 10. Mattress 26 is configured as a no-flip or one-sided mattress by utilizing a bottom support layer 28 that is intended to remain underneath core 10 (on the non-sleeping surface). One feature of support layer 28 is that it is bonded to core 10, and in particular to the fabric pockets 14. This holds the bottoms of springs 12 together to prevent or substantially reduce their lateral movement. In this way, mattress 16 has greater stability while still maintaining comfort by permitting the tops of springs 12 to move independent of one another. Another advantage is that border rods 22 are not needed to couple support layer 28 to core 10, and in some cases may be eliminated altogether, at least on the bottom of the mattress.

Support layer 28 may be bonded to pockets 14 using a bonding material such as a hot melt glue, a latex glue or the like. In some cases, a layer of non-woven fabric may be placed between core 10 and support layer 28. In such a case, the fabric may be attached or glued to the support layer 28, and the fabric may then be secured to core 10, such as by the use of hog rings that are coupled to the springs. In this way, glue does not need to contact core 10. Pockets 14 may be constructed of a material such as Duon™, Versare™ or a non-woven fabric to facilitate bonding. To bond support layer 28 to core 10, the bonding material may be deposited onto support layer 28 and/or to pockets 14 and the two placed adjacent to each other. This may be done on a conveyor to reduce manufacturing times.

Support layer 28 may be constructed of a relatively dense material to increase the durability of mattress 26. For example, support layer 28 may have a density greater than about 3 pounds per cubic foot. One exemplary material is rebond (a carpet padding material) and may have a thickness of about 0.5 inches to about 3 inches. Such a material is relatively inexpensive to reduce the cost of mattress 26. Such a material is also relatively stiff, having a stiffness of about 40 IFD to about 80 IFD, and more preferably from about 50 IFD to about 70 IFD.

Disposed on top of core 10 is a top padding layer 30 and may be constructed of a material such as a polyurethane or latex foam, a visco-elastic or memory foam material, or the like. Top padding layer may simply rest on core 10 to permit independent movement of springs 12.

Positioned on top of layer 30 is a quilted layer 32 that provides additional padding to the user and serves as the sleeping surface for mattress 26. Sewn to layer 32 are sides 34, and sewn to sides 34 is a bottom cover 26. Side 34 and bottom cover 36 are constructed of conventional fabrics and protect the interior components of mattress 36 as well as providing an aesthetically pleasing surface.

Mattress 26 is constructed such that the top surface formed by layer 32 is the only sleeping surface. In this way, mattress 26 does not need to be periodically flipped to the other side. Further, by using a dense bottom support layer, mattress 26 has a durable construction to provide increase life. Mattress 26 also has improved stability by stabilizing the bottoms of the springs.

Figure 4:
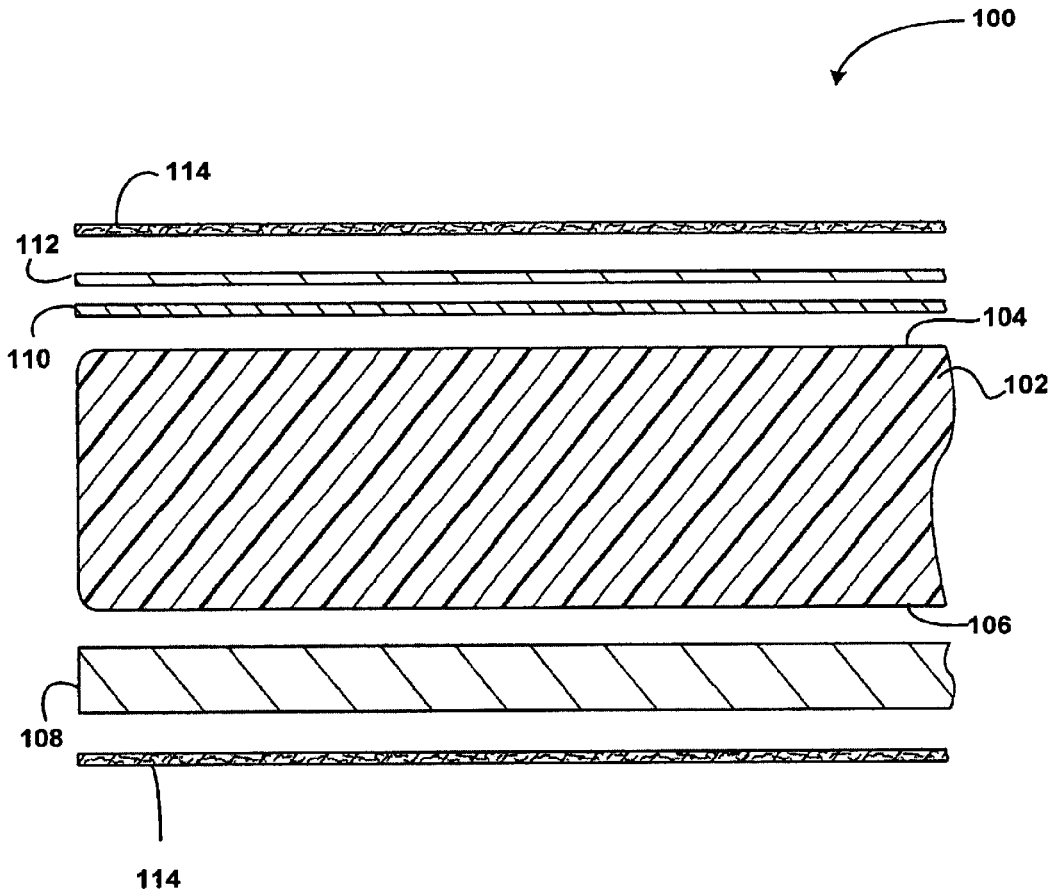
FIG. 4 is an exploded cross sectional side view of another embodiment of a mattress according to the invention.
Figure 5:
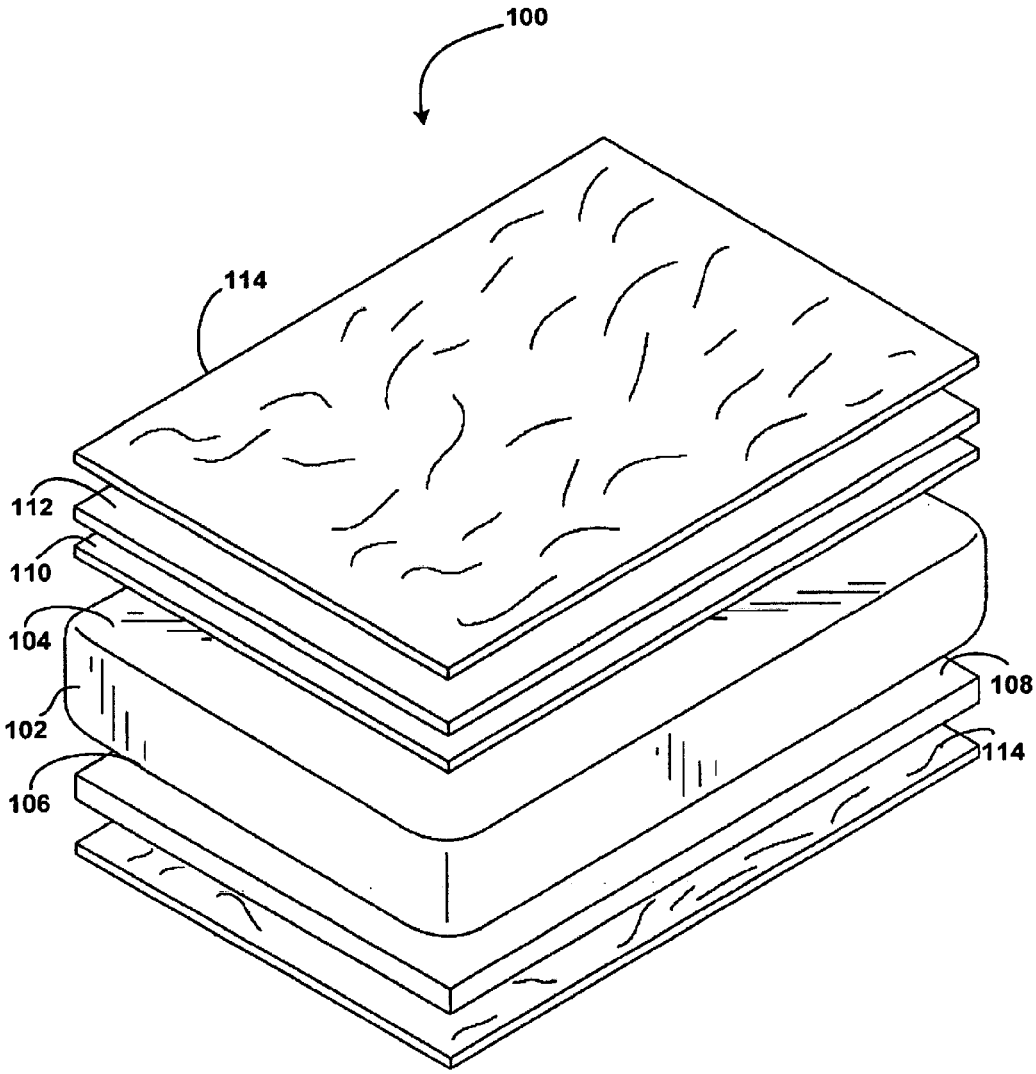
FIG. 5 is a perspective view of the mattress of FIG. 4.

Referring now to FIGS. 4 and 5, another embodiment of a mattress 100 will be described. Mattress 100 is constructed of a core 102 for supporting the user. A wide variety of cores may be used. For example, core 102 may comprise springs individually encased in fabric as described in connection with other embodiments. Other examples of cores include open coil springs, latex rubber cores, visco elastic or memory foam cores, inflatable bladders, other cores as are known in the art, and the like. Core 102 includes a top side 104 and a bottom side 106. Top side 104 provides a sleeping surface for the user.

Disposed beneath core 102 is a bottom support layer 108 that provides a general support for core 102. Bottom support layer 108 may be relatively dense and firm to provide the appropriate amount of support to the mattress. For example, bottom support layer 108 may have a density of at least about 1 pound per cubic foot, and more preferably at least about 3 pounds per cubic foot. The firmness may be in the range from about 30 IFD to about 80 IFD, although materials that are more firm could also be used. Materials that may be used to construct bottom support layer 108 may be any of the materials described herein with respect to other embodiments, such as a matrix of foam elements. Other materials include polyurethane foams, visco elastic materials, latex rubber, densified fibers, and the like.

Bottom support layer 108 may be coupled to core 102 using a variety of techniques, including, the use of hog rings, glue, stitching, staples and the like. A border rod may also be used, although in some instances a foam casing may be used. In some cases, a layer of fabric may be placed between core 102 and support layer 108.

A wide variety of optional padding layers may be placed on top side 104 of core 102. These layers may be selected to provide the desired amount of comfort. More specifically, mattress 100 may include a pair of foam layers 110 and 112 similar to the foam layers described in copending U.S. application Ser. No. 10/704,879, filed on Nov. 10, 2003 and incorporated herein by reference. These padding layers may be incorporated into the quilting to form a pillow top mattress, or may not be incorporated directly into the quilting to form a plush top mattress.

Optionally, a backing material may be placed next to core 102 for protection of core 102. One or more intermediate padding layers (not shown) may be positioned between core and layers 110 and 112. The intermediary layers may be used to provide the mattress with additional comfort. These layers may be used alone or in various combinations. For example, one intermediary layer may comprise a foam material, such as a polyurethane foam. One particular type of polyurethane foam that may be used is one having a density in the range from about 0.5 pounds per cubic foot to about 1.9 pounds per cubic foot, and more preferably from about 0.5 pounds per cubic foot to about 0.9 pounds per cubic foot. The firmness of layer 24 may be in the range from about 5 IFD to about 23 IFD, and more preferably from about 5 IFD to about 10 IFD. This intermediary layer may have a thickness in the range from about 0.5 inches to about 3 inches, and could have one or more convoluted surfaces. Polyurethane foams with such characteristics are manufactured under the trade name Quiltflex from FoamEx, Inc. Such a material was initially developed for the upholstery business and was discovered by the inventors to be especially useful with mattresses as described herein.

Another intermediary layer may comprise a piece of latex rubber or a visco elastic material. One or both sides of this layer could also be convoluted and may have a thickness in the range from about 0.5 inches to about 3 inches. Other materials that may be used as an intermediate layer include fiber padding materials.

As will be described in more detail hereinafter, one of layers 110 or 112 may have a contoured surface, and the other padding layer is placed adjacent to the contoured surface. The contoured surface may have a variety of configurations. For example, one type of contoured surface is a convoluted surface having alternating peaks and valleys similar to an egg carton. One example of this type of surface design is described in U.S. Pat. No. 5,317,768, incorporated herein by reference. Other types of contoured surfaces include ribs, zigzags, other surface modified foams that may have essentially any type of design, including patterns defining regions of higher and lower firmness, and the like.

The padding layer having the contoured surface may be constructed from a polyurethane foam, although other materials could be used as well. In one arrangement, layer 110 comprises a polyurethane foam having a flat surface and a convoluted surface that faces away from core 102. In this way, layer 110 is positioned between layer 112 and core 102. Layer 110 may have a density in the range from about 0.5 pounds per cubic foot to about 3 pounds per cubic foot, and sometimes from about 1.6 pounds per cubic foot to about 1.9 pounds per cubic foot. Layer 110 may have a firmness in the range from about 8 IFD to about 45 IFD. Layer 110 may have a thickness in the range from about ⅜ inches to about 3 inches, and sometimes about 1 inch to about 1.5 inches. Conveniently, the peaks may be about half the total thickness of layer 28.

Layer 112 provides a variety of important features when placed against the peaks of the convoluted surface. Layer 112 when placed adjacent the peaks of layer 110 better conforms to the user's body as compared to just a convoluted surface. This provides additional comfort to the user. Further, because of the density and firmness of layer 112, it alone has a luxurious feel. When used in combination with convolutions, a high degree of comfort is provided to the user. As an additional feature, material costs can be reduced because two pieces of convoluted foam can be produced form a single piece of foam. For example, two layers 110 may have a height of about 1¼ inch and be produced from a piece of foam having a height of about 1.5 inches. This allows two contoured foam pieces to have a combined height of 2.5 inches. This can reduce the cost of layer 110 (as compared to using a piece of flat foam) by up to about 50%. When this layer is combined with layer 112, a plush and luxurious feel is produced at a reduced cost. For example, layer 112 may be about one inch while layer 110 is about 1¼ inch. This is about the same height as the original foam piece from which layer 110 was produced, but has a much more luxurious and body-conforming feel.

Layers 110 and 112 may be flipped so that the convoluted surface faces toward core 102. Also, layer 112 is positioned between layer 110 and core 102.

Mattress 100 also includes a layer of ticking 114 that is a piece of fabric or quilting that envelopes the mattress as is known in the art. Ticking 114 may comprise essentially any type of fabric or covering and may be sewn to form it around the core and other padding layers. Layers 110 and 112 may be incorporated into ticking 114 using a gusset that sits beneath layer 112 to form a pillow top. Alternatively, ticking 114 may be placed over layer 112 and along the sides of the mattress to form a plush top mattress.

As mentioned herein, intermediate layers may be positioned between core 102 and layers 110 and 112. In some cases, additional layers could also be placed on top of layers 110 and 112. As another variation, a mattress may include multiple combinations of layers 110 and 112 on the same side of the core. These could be adjacent to each other or separated by other layers. For example, in some cases two padding layers 112 may be used in combination with the padding layer 110 having the contoured surface. The padding layers 112 may both be positioned on top of layer 110, or one may be above and one below. In another alternative, the mattress may include two layers 110 of foam that are convoluted in combination with layer 112. For example, the two layers 110 may have their contoured surfaces facing up, with layer 112 resting on the contoured surface of the top layer 110. As another example, one of the layers 110 may having its contoured surface facing up with the other layer 110 having its contoured surface facing down. Layer 112 rests on the contoured surface of the top one of layers 110.

The invention has now been described in detail for purposes of clarity and understanding. However, it will be appreciated that certain changes and modifications may be practiced within the scope of the appended claims.

What is claimed is:

1. A no-flip mattress comprising:

a mattress core;

a first padding layer positioned on top of the core, wherein the first padding layer has a density in the range from about 0.5 pounds per cubic foot to about 3 pounds per cubic foot and a firmness in the range from about 8 IFD to about 45 IFD;

a second padding layer adjacent to the first padding layer, wherein the second padding layer has a density in the range from about 0.5 pounds to about 1.9 pounds, and an IFD in the range from about 5 to about 23; and a bottom support layer beneath the core, wherein the bottom support layer comprises a relatively dense and firm material;

wherein the first padding layer has a contoured surface that is positioned against the second padding layer.

2. A mattress as in claim 1, wherein the core comprises a plurality of springs, and further comprising individual fabric pockets encasing each spring.

3. A mattress as in claim 2, wherein the fabric pockets are disposed in rows, and wherein adjacent rows of the fabric pockets are connected to each other near midpoints of each of the pockets.

4. A mattress as in claim 1, wherein the bottom support layer is selected from a group of support layers consisting of a matrix of foam elements, a polyurethane foam and fibers.

5. A mattress as in claim 4, wherein the bottom support layer has a firmness in the range from about 30 IFD to about 80 IFD.

6. A mattress as in claim 4, wherein the bottom support layer has a thickness in the range from about 0.5 inches to about 3 inches.

7. A mattress as in claim 1, wherein the core is selected from a group consisting of spring cores, latex cores, visco-elastic cores and bladders.

8. A mattress as in claim 1, wherein the bottom support layer has a density greater than about one pound per cubic foot.

9. A mattress as in claim 1, wherein the contoured surface of the first layer is convoluted and faces away from the core.

10. A mattress as in claim 1, wherein the first padding layer and the second padding layer comprise polyurethane foam.

11. A mattress as in claim 1, further comprising a quilted material disposed on top of the first and second padding layers.

12. A mattress as in claim 1, farther comprising a border material disposed around sides of the mattress core.

13. A mattress as in claim 1, further comprising a cover material disposed over the bottom support layer.

14. A method for constructing a mattress, the method comprising:

providing a mattress core;

placing a first padding layer on top of the core, the first padding layer having a contoured surface, wherein the first padding layer has a density in the range from about 0.5 pounds per cubic foot to about 3 pounds per cubic that and a firmness in the range from about 8 IFD to about 45 IFD;

placing a second padding layer adjacent to the contoured surface of the first padding layer, wherein the second padding layer has a density in the range from about 0.5 pounds to about 1.9 pounds, and an IFD in the range from about 5 to about 23; and placing a relatively firm and dense bottom support layer beneath the mattress core.

15. A method as in claim 14, wherein the core comprises a plurality of springs disposed in fabric pockets, wherein the fabric pockets are disposed in rows, and wherein adjacent rows of the fabric pockets are connected to each other near midpoints of each of the pockets.

16. A method as in claim 14, wherein the core is selected from a group consisting of spring cores, latex cores, visco-elastic cores and bladders.

17. A method as in claim 14, wherein the bottom support layer comprises a matrix of foam elements.

18. A method as in claim 17, wherein the bottom support layer has a firmness in the range from about 30 IFD to about 80 IFD.

19. A method as in claim 14, wherein the bottom support layer is selected from a group consisting of bonded foam elements, polyurethane foam and fibers.

20. A method as in claim 14, wherein the bottom support layer has a density of about one pound per cubic foot or greater.

21. A method as in claim 14, wherein the first padding layer and the second padding layer comprise polyurethane foam, and wherein the contoured surface is convoluted and faces away from the core.

22. A method as in claim 14, wherein the second padding layer has a height in the range from about ⅜ inch to about 3 inches.

23. A method as in claim 14, further comprising incorporating the first and second padding layers into a quilting.

24. A method as in claim 14, further comprising placing a border material around sides of the core.

25. A method as in claim 14, further comprising placing a cover material over the bottom support layer.

* * * * *